US005152667A

United States Patent [19]

Turner et al.

[11] Patent Number: 5,152,667

[45] Date of Patent: Oct. 6, 1992

[54] COOLED WALL STRUCTURE ESPECIALLY FOR GAS TURBINE ENGINES

[75] Inventors: Edward R. Turner, Indianapolis; Jeffrey F. Rhodes, Zionsville; Larry A. Junod, Clayton, all of Ind.

[73] Assignee: General Motors Corporation, Detroit, Mich.

[21] Appl. No.: 730,729

[22] Filed: Jul. 16, 1991

[51] Int. Cl.[5] ..... F01D 5/18

[52] U.S. Cl. ..... 416/97 R

[58] Field of Search ..... 416/95, 97 R; 165/169; 60/752, 754, 755

[56] References Cited

U.S. PATENT DOCUMENTS

| | | | |
|---|---|---|---|
| 2,149,510 | 3/1939 | Darrieus | 60/41 |
| 3,067,982 | 12/1962 | Wheeler, Jr. . | |
| 3,584,972 | 6/1971 | Meginnis et al. | 416/229 |
| 3,616,125 | 10/1971 | Bowling | 416/97 |
| 3,672,787 | 6/1972 | Thorstenson | 416/97 |
| 4,118,146 | 10/1978 | Dierberger | 415/115 |
| 4,312,186 | 1/1982 | Reider | 60/754 |
| 4,315,406 | 2/1982 | Bhangu et al. | 60/754 |
| 4,595,298 | 6/1986 | Frederick | 416/97 |
| 4,676,719 | 6/1987 | Auxier et al. | 416/97 |
| 4,695,247 | 9/1987 | Enzaki et al. | 60/755 |
| 4,751,962 | 6/1988 | Havekost et al. | 60/754 |

FOREIGN PATENT DOCUMENTS

| | | | |
|---|---|---|---|
| 197402 | 11/1983 | Japan | 416/97 |
| 187501 | 8/1986 | Japan | 416/97 |

*Primary Examiner*—John T. Kwon

*Attorney, Agent, or Firm*—Saul Schwartz

[57] ABSTRACT

A cooled wall structure including a hot side, a cold side, a linear slot opening through the hot side, a plurality of diffusion chambers below the hot side separated therefrom by relatively thin bridge sections of the wall structure and arrayed in checkerboard fashion on opposite sides of the linear slot and opening into the linear slot through the sidewalls thereof, and a plurality of passages from the cold side to each of the diffusion chambers. The cold side is exposed to coolant gas under pressure and the passages are aimed at the bridge sections so that jet of cooling gas issuing from the passages impinge against the bridge section for convection cooling the hot side. The bridge sections prevent direct penetration of the coolant gas jets into the environment adjacent the hot side. The coolant gas flows from the diffusion chambers into the linear slots and from the linear slots over the hot side to form on the latter a coolant film or blanket.

2 Claims, 1 Drawing Sheet

COOLED WALL STRUCTURE ESPECIALLY FOR GAS TURBINE ENGINES

FIELD OF THE INVENTION

This invention relates to cooling for metal wall structures exposed to sources of high temperature such as hot gasses in gas turbine engines.

BACKGROUND OF THE INVENTION

U.S. Pat. No. 3,584,972, issued Feb. 9, 1966 and assigned to the assignee of this invention, describes a transpiration cooled wall structure having tortuous internal passages between holes or pores in each side of the wall structure. With one side of the wall structure, i.e. the hot side, exposed to a source of high temperature such as hot gasses flowing in a hot gas flow path of a gas turbine engine and the other side, i.e. the cold side, exposed to coolant gas under pressure, the coolant gas migrates through the internal passages for convection cooling and issues from the hot side pores to form a cooling film or blanket over the hot side. U.S. Pat. No. 3,672,787, issued Jun. 27, 1972, describes a transpiration cooled wall for an airfoil in which the hot side pores are relatively short, parallel slots. U.S. Pat. No. 4,676,719, issued Jun. 30, 1987, describes a cooled airfoil wall structure in which a common slot in the cold side intersects the sides of a plurality of separate diffusion passages which merge to define a linear slot in the hot side of the wall structure oriented in the spanwise direction of the airfoil. Coolant issues from the linear slot to form a film or blanket over the hot side downstream of the slot. U.S. Pat. No. 2,149,510, issued Mar. 7, 1939, describes an airfoil wall structure having a plurality of slots at the leading edge of and in the spanwise direction of the airfoil from which coolant gas flows to form a film or blanket over the hot side.

SUMMARY OF THE INVENTION

This invention is a new and improved cooled wall structure including a hot side exposed to a source of high temperature, a cold side exposed to coolant gas under pressure, a plurality of parallel linear slots in the hot side, and a plurality of diffusion chambers below the hot side arrayed in checkerboard fashion on opposite sides of the linear slots. A plurality of thin bridge sections of the wall structure separate the diffusion chambers from the hot side. The diffusion chambers open into adjacent ones of the linear slots through the sides of the slots. A plurality of passages in the wall structure from the cold side thereof to respective ones of the diffusion chambers conduct coolant gas to the diffusion chambers such that the coolant gas issues from the passages as jets which impinge on the bridge sections for hot side convection cooling. The coolant gas diffuses in and issues from the diffusion chambers into the linear slots and then flows from the linear slots over the hot side to define thereon a coolant film or blanket. In a preferred embodiment, the cooled wall structure according to this invention is a wall structure segment of a gas turbine engine turbine blade located generally at the leading edge of the airfoil of the blade.

DESCRIPTION OF PREFERRED EMBODIMENTS

Figure 1:
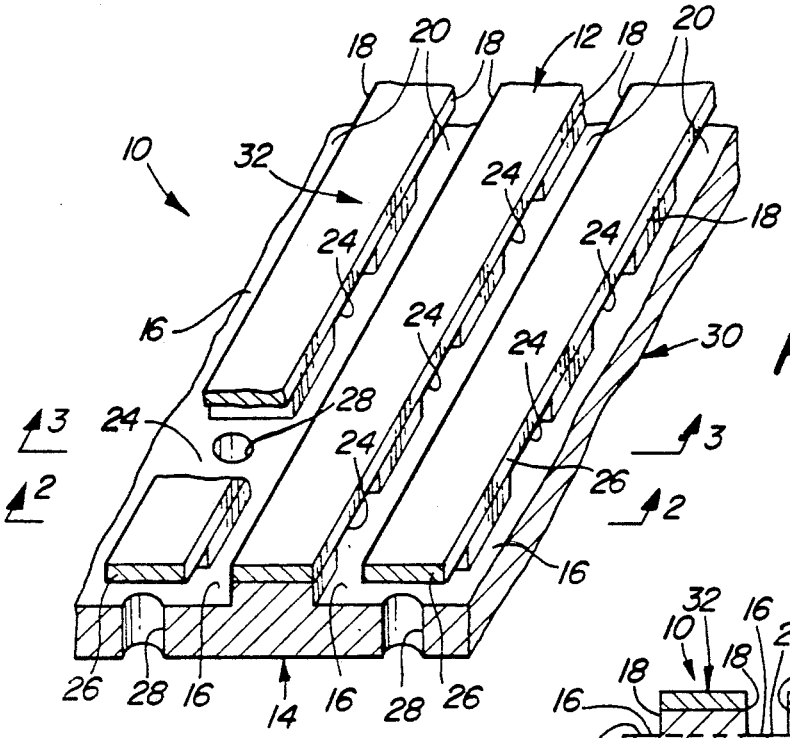
FIG. 1 is a fragmentary, partially broken-away perspective view of a cooled wall structure according to this invention.
Figure 2:
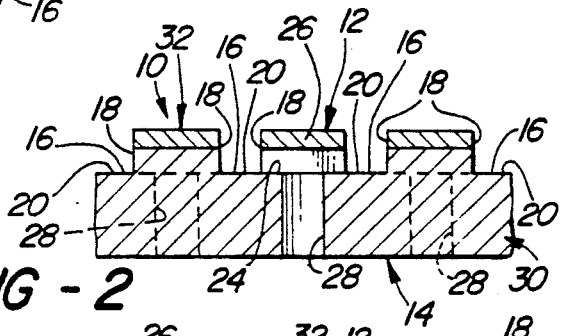
FIG. 2 is a sectional view taken generally along the plane indicated by lines 2—2 in FIG. 1.
Figure 3:
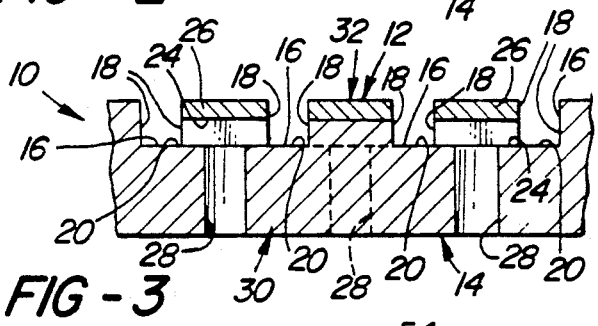
FIG. 3 is a sectional view taken generally along the plane indicated by lines 3—3 in FIG. 1.

Referring to FIGS. 1-3, a cooled wall structure (10) according to this invention includes a first or hot side (12) and a second or cold side (14). The hot side is exposed to a source of high temperature such as a hot gas stream in a gas turbine engine, not shown. The cold side is exposed to coolant gas under pressure such as compressed air derived from a compressor, not shown, of a gas turbine engine. The coolant gas pressure at the cold side exceeds the hot gas pressure at the hot side.

The wall structure (10) further includes a plurality of linear, i.e. straight, slots (16) opening through the hot side (12). Each slot (16) has a pair of side walls (18) and a bottom (20). The linear slots are flanked on opposite sides by a plurality of diffusion chambers (24) in the wall structure (10) below the hot side (12). The diffusion chambers are separated from the hot side (12) by respective ones of a plurality of thin bridge sections (26) of the wall structure. Each diffusion chamber (24) opens into adjacent ones of the linear slots (16A-D) through the side walls (18) of the slots. The diffusion chambers are arrayed in checkerboard fashion so that the chambers on one side of a linear slot are not aligned with the chambers on the other side of the same slot.

A plurality of passages (28) in the wall structure (10) extend from the cold side (14) to respective ones of the diffusion chambers (24) and are aimed at corresponding ones of the bridge sections (26). The pressure gradient across the wall structure (10) in the direction of the hot side (12) induces coolant gas flow through the passages (28) and into the diffusion chambers (24). The coolant gas issues for the passages as coolant jets which impinge on corresponding ones of the bridge sections (26) of the wall structure for convection cooling the hot side (12).

Impingement of the coolant jets against the bridge sections breaks-up or diffuses the jets in the diffusion chambers and forecloses direct penetration by the jets of the hot gas environment adjacent the hot side (12). The coolant gas further diffuses from the diffusion chambers into the adjacent linear slots (16) with reduced momentum relative to the momentum of the gas issuing from the passages (28). The coolant gas then flows out of the linear slots (16) and spreads across the hot side as a film or blanket which, due to the lack of momentum of the coolant gas perpendicular to the hot side, tends to remain attached to or adjacent the hot side.

The wall structure (10) may conveniently be manufactured as a laminate or as a casting. For laminate manufacture, a first alloy metal lamina (30), CMSX-3 for example, is preferably electrochemically etched on one side to a depth of about 0.007-0.010 inch to define a plurality of raised pedestals corresponding to the portions of the wall structure (10) between the diffusion chambers (24) and also to define the bottoms (20) and the side walls (18) of the linear slots (16) between the pedestals. The passages (28) may then be mechanically, electrochemically or otherwise formed in the wall structure (10) between the pedestals. A second alloy metal lamina (32), HA188 for example, of the same thickness as the bridge sections (26) of the wall structure (10) is diffusion bonded to the first lamina at the interfaces between the second lamina and the pedestals. The second lamina is then saw cut or otherwise machined between the pedestals to open the linear slots (16) through the hot side (12) of the wall structure. For additional high temperature protection of the hot side, the hot side may be coated with a conventional thermal barrier coat before the second lamina is saw cut to open the linear slots. In the latter circumstance, applying the thermal barrier coat before final machining of the second lamina avoids contamination of the linear slots and/or the diffusion chambers by overspray of thermal barrier coat material.

Figure 4:
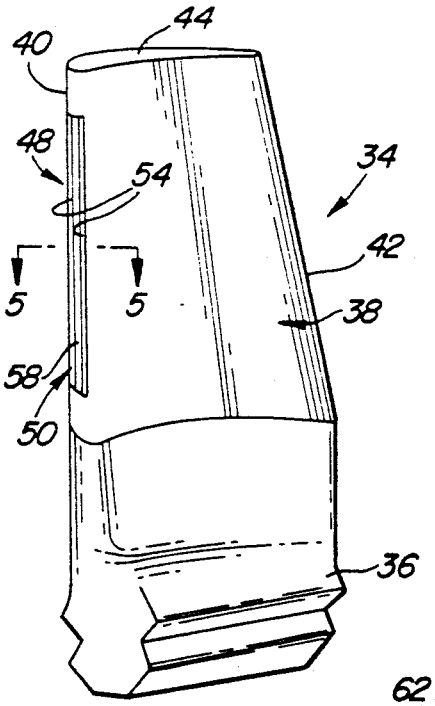
FIG. 4 is an elevational view of a gas turbine engine turbine blade having a cooled wall structure segment according to this invention.
Figure 5:
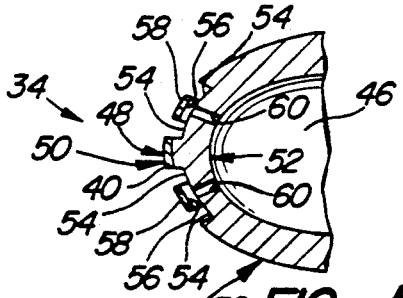
FIG. 5 is an enlarged, fragmentary sectional view taken generally along the plane indicated by lines 5—5 in FIG. 4.

Referring to FIGS. 4–5, a preferred application for the wall structure according to this invention is in a gas turbine engine turbine blade (34) having a root (36) for attachment to a turbine wheel and an integral spar wall (38). The wall (38) defines an airfoil having a leading edge (40), a trailing edge (42), a blade tip (44), and a coolant gas plenum (46) inside the wall into which compressed air from a compressor of the gas turbine engine is introduced through a duct, not shown, in the root (36). The wall (38) has a cooled wall structure segment (48) at the leading edge (40) of the airfoil flanked on opposite sides by the remainder of the spar wall which may be solid or may include other cooling features as necessary.

The wall structure segment (48) of the spar wall (38) has a hot side (50) exposed to a stream of hot gas flowing downstream from ahead of the leading edge (40) to aft of the trailing edge (42) and a cold side (52) exposed to compressed air in the plenum (46). The wall structure segment (48) further includes a plurality of linear slots (54) opening through the hot side (50) and extending in the spanwise direction of the spar from near the root (36) to near the blade tip (44). The slots are flanked on opposite sides by a plurality of diffusion chambers (56) below the hot side arrayed in checkerboard fashion. The diffusion chambers (56) are separated from the hot side (50) by a plurality of bridge sections (58) of the wall structure segment.

The diffusion chambers (56) are connected to the plenum (46) by a plurality of passages (60). Compressed air from the plenum (46) issues into the diffusion chambers from the passages (60) as coolant jets which impinge against the bridge sections (58) for convection cooling of the hot side (50). Impingement of the coolant jets against the bridge sections breaks-up or diffuses the jets in the diffusion chambers and forecloses the jets from directly penetrating, and thereby upsetting, the hot gas stream around the airfoil. The coolant gas further diffuses from the diffusion chambers into the adjacent linear slots (54) with reduced momentum relative to the momentum of the gas issuing from the passages (60). The coolant gas flows from the linear slots (54) and is spread across the spar wall by the flowing hot gas as a film or blanket protecting the spar wall from the high temperature gas. In a representative application, it is contemplated that the linear slots will be on the order of 0.020 inches wide and, 0.025–0.030 inches deep, that the passages (60) will have diameters of the order of about 0.020 inch and be spaced about 0.050–0.070 inch apart, and that the diffusion chambers will be about 0.007–0.010 inch deep and 0.030–0.040 inch long.

Figure 6:
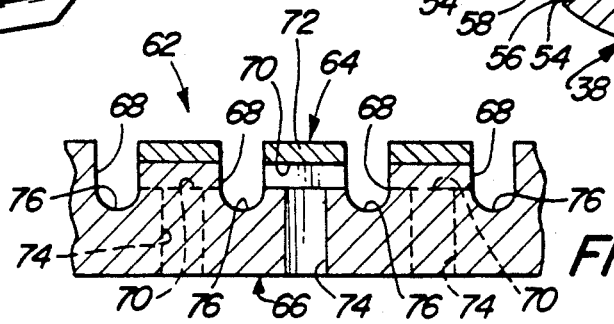
FIG. 6 is similar to FIG. 2 but showing a modified cooled wall structure according to this invention.

A modified transpiration cooled wall structure (62) according to this invention is illustrated in FIG. 6 and includes a hot side (64), a cold side (66), and a plurality of parallel linear slots (68) opening through the hot side (64). The linear slots (68) are flanked on opposite sides by a plurality of diffusion chambers (70) arrayed in checkerboard fashion and separated from the hot side by a plurality of bridge sections (72). A plurality of passages (74) extend from respective ones of the diffusion chambers (70) to the cold side (66). Each of the linear slots (68) has a bottom (76) recessed below the diffusion chambers (70).

The modified wall structure (62) is cooled as described above with respect to wall structure (10). The recessed bottoms (76) of the linear slots define debris traps in which foreign particles directed against the hot side (64) may lodge without impairing the flow of coolant gas from the diffusion chambers into the linear slots.

We claim:

1. A cooled wall structure for a gas turbine engine blade spar comprising:

a hot side exposed to a source of high temperature, a cold side exposed to a coolant gas at a pressure exceeding the pressure at said hot side, means defining a linear slot in said wall structure generally at a leading edge of an airfoil defined by said wall structure and open through said hot side and including a pair of opposite side walls and a bottom between said side wall, means defining a plurality of diffusion chambers in said wall structure arrayed in checkerboard fashion on opposite sides of said linear slot each opening into said linear slot through an adjacent one of said side walls of said slot and each separated from said hot side of said wall structure by a relatively thin bridge section of said wall structure, and means defining a plurality of passages in said wall structure from said cold side to respective ones of said diffusion chambers perpendicular to and aimed at said bridge sections so that jets of coolant gas issuing from said passages impinge on corresponding ones of said bridge sections for convection cooling said hot side, said coolant thereafter flowing from said diffusion chambers into said linear slot and from said liner slot over said hot side of said wall structure with minimal momentum perpendicular to said hot side so that said coolant gas defines a film on said hot side between said hot side and said source of high temperature.

2. The wall structure recited in claim 1 wherein said bottom of said linear slot is recessed below said diffusion chambers to define a debris trap in said linear slot.

* * * * *